US005541042A

United States Patent [19]

Ura et al.

[11] Patent Number: 5,541,042

[45] Date of Patent: Jul. 30, 1996

[54] METHOD OF CARRYING PHOTOSENSITIVE MATERIALS IN A PHOTOGRAPHIC PRINTER MACHINE

[75] Inventors: Hiroyoshi Ura; Akifumi Uenoyama, both of Wakayama, Japan

[73] Assignee: Noritsu Koki Co., Ltd., Wakayama, Japan

[21] Appl. No.: 395,996

[22] Filed: Feb. 28, 1995

[30] Foreign Application Priority Data

Feb. 28, 1994 [JP] Japan ..... 6-029677
Nov. 18, 1994 [JP] Japan ..... 6-285146

[51] Int. Cl.[6] ..... G03C 5/29; G03D 3/10

[52] U.S. Cl. ..... 430/403; 354/319; 354/320

[58] Field of Search ..... 430/403, 434; 354/319, 320

[56] References Cited

U.S. PATENT DOCUMENTS 5,374,972 12/1994 Nakane ..... 354/319

5,430,520 7/1995 Toki et al. ..... 354/319

*Primary Examiner*—Richard L. Schilling

*Attorney, Agent, or Firm*—Wenderorth, Lind & Ponack

[57] ABSTRACT

A photosensitive material transfer method in a photographic printer machine includes a multiple-row transfer mode in which the photosensitive material pieces are separated into multiple rows and the rows of the photosensitive material pieces are transferred in controlled speeds and an inter-row transfer mode in which other photosensitive material pieces are carried across regions between the multiple rows so as to run in one or more rows. The multiple-row transfer mode and the inter-row transfer mode are selectively effected during the transfer of photosensitive material pieces from an exposure station to a development station.

6 Claims, 15 Drawing Sheets

20B
20
13
10
20A
PC1

20B
PC1
13
20A

20B
PC1
13
20A

20B
PC1
13
20A
PC2

PC2
20B
13
PC1
20A
PC3

20
20B
PC
13
20A

PC2
20B
PC3
PC1
20A
13

METHOD OF CARRYING PHOTOSENSITIVE MATERIALS IN A PHOTOGRAPHIC PRINTER MACHINE

BACKGROUND OF THE INVENTION

The present invention relates to a method of carrying photosensitive materials in parallel rows in a photographic printer machine to prevent its transfer sections from being fouled during the development process.

Common photographic printers are designed in which a continuous strip of material is supplied from a roll, exposed to light on an exposure bed in the exposure station to print frames of images from a negative film, passed through tanks filled with developing liquids, and dried out before being unloaded.

The strip of photosensitive material exposed on the exposure bed is separated into pieces of a frame size for ease of the development process. A resultant series of frame pieces are transferred to the development station in a row while spaced one from another by some tens of millimeters so that they do not overlap each other in the development station.

In such a conventional photographic printer machine, the photosensitive materials are processed at a slower speed in the development station than in the exposure station. For increasing the performance speed of the conventional photographic printer machine, it is essential to improve the processing capability at the development station.

Although the feeding speed of the photosensitive material in a single row has been adjusted to a fastest possible rate, it has a substantial limitation. In a modification, the transfer section in the development station has an increased rack length to process a greater number of frames of photosensitive material in a given time. The longer the rack length, the faster the transfer speed across the development station is determined.

However, as the rack length of the transfer section is increased, the overall length of the development station increases. This requires larger tanks and thus larger amounts of developing liquids and more liquids needed for replenishment. If the processing ability is increased, for example, from 500 frames/time to 1000 frames/time while the width of the frame of the photosensitive material remains unchanged, the rack length has to be increased by about 2.1 times, the amounts of the developing liquids by 2 times, and the liquid replenishments also by 2 times.

To overcome the foregoing disadvantages of the conventional development station, we, the applicants, proposed in our previous application a modified development method and its apparatus in which the frame pieces of the photosensitive material transferred from the exposure station are alternately dislocated from a transfer path to the left and to the right to have a zigzag form before being fed to the development station.

A drawback of the method and the apparatus is that while the frame pieces of the photosensitive material are carried in two rows over transfer rollers in the development station, they leave dirt on intermediate regions of the rollers between two rows. If a wider size of the photosensitive material is introduced into the development station, it runs over the intermediate regions of the rollers and will thus be fouled with the dirt.

Such dirt or waste results from oxidation and deterioration of chemical ingredients of the developing liquids which may be caused with time and when the temperature is changed during a long run of the development process. The dirt on the transfer rollers may more or less tar the edges of the frame pieces which run in two rows. There are thus needed some extra maintenance tasks of cleaning the rollers and their support rack and replacing the developing liquids with fresh ones or replenishing periodically for retarding the deterioration of the developing liquids.

SUMMARY OF THE INVENTION

It is an object of the present invention, in view of eliminating the fouling with such dirt during the transfer of a photosensitive material in a zigzag form across the development station, to provide a photosensitive material transfer method in which frame pieces of a photosensitive material are transferred in parallel rows with such proper timing provided for adjusting between the two rows as to save the running cost, prevent the fouling with dirt, and increase the processing capability, without performing the conventional maintenance tasks of cleaning the transfer rollers and their support rack, replacing the developing liquids or replenishing the same at short time intervals.

A photosensitive material transfer method for use in a photographic printer machine according to the present invention is characterized by during the transfer of photosensitive material pieces from an exposure station to a development station selecting between a multiple-row transfer mode in which the exposed photosensitive material pieces are separated into multiple rows and the rows of the photosensitive material pieces are transferred in controlled speeds and an inter-row transfer mode in which other non-exposed photosensitive material pieces are carried across regions between the multiple rows so as to run in one or more rows.

The selection may be conducted by when the transfer action is continued after a given interval of stop action, carrying out the inter-row transfer mode action and then, shifting to the multiple-row transfer mode.

In the above method, the transfer action may be shifted from the multiple-row transfer mode to the inter-row transfer mode when the count of photosensitive material pieces carried in multiple rows reaches a given number.

The shift of the transfer of the photosensitive material pieces from the multiple-row transfer mode to the inter-row transfer mode may be executed at every request of a film printing or in any intermediate length point of the request.

The shift of the transfer to the inter-row transfer mode may be executed when the total number of frames minus (number of rows of photosensitive material pieces $-1$)<number of current frames$\leqq$total number of frames is satisfied.

The shift of the transfer from the multiple-row transfer mode to the inter-row transfer mode may be executed with efficiency when a film length contains more than a predetermined number of frames.

As set forth above, the photosensitive material transfer method of the present invention allows the transfer action to be selected between the multiple-row transfer mode and the inter-row transfer mode. The inter-row transfer mode action is used for removing from rollers in the development station depositions of dirt which have been accumulated on regions between the rows during the transfer of the photosensitive material pieces so that succeeding pieces can be prevented from being fouled at their backs and edges.

Such dirt has to be removed from the rollers before a row of photosensitive material pieces of a wider size are transferred through the development station after the transfer of standard sized pieces in rows is conducted for a considerable period of time.

In case that the shift from the multiple-row transfer mode to the inter-row transfer mode is selected to perform a cleaning process when the transfer action is continued after a given interval of stop action, the non-exposed photosensitive material pieces may be loaded in one or more rows for the purpose of cleaning the rollers.

Also in case of shifting from the multiple-row transfer mode to the inter-row transfer mode when the count of photosensitive material pieces carried in multiple rows reaches a given number, not all the photosensitive material pieces are fouled with dirt during running along transfer paths in the development station. Hence, one or more of the photosensitive material pieces can do a cleaning task by running in the inter-row transfer mode. Accordingly, the action of selected photosensitive material pieces will prevent dirt from accumulating.

DETAILED DESCRIPTION OF THE PREFERRED EMBODIMENTS

Preferred embodiments of the present invention will be described referring to the accompanying drawings.

Figure 1:
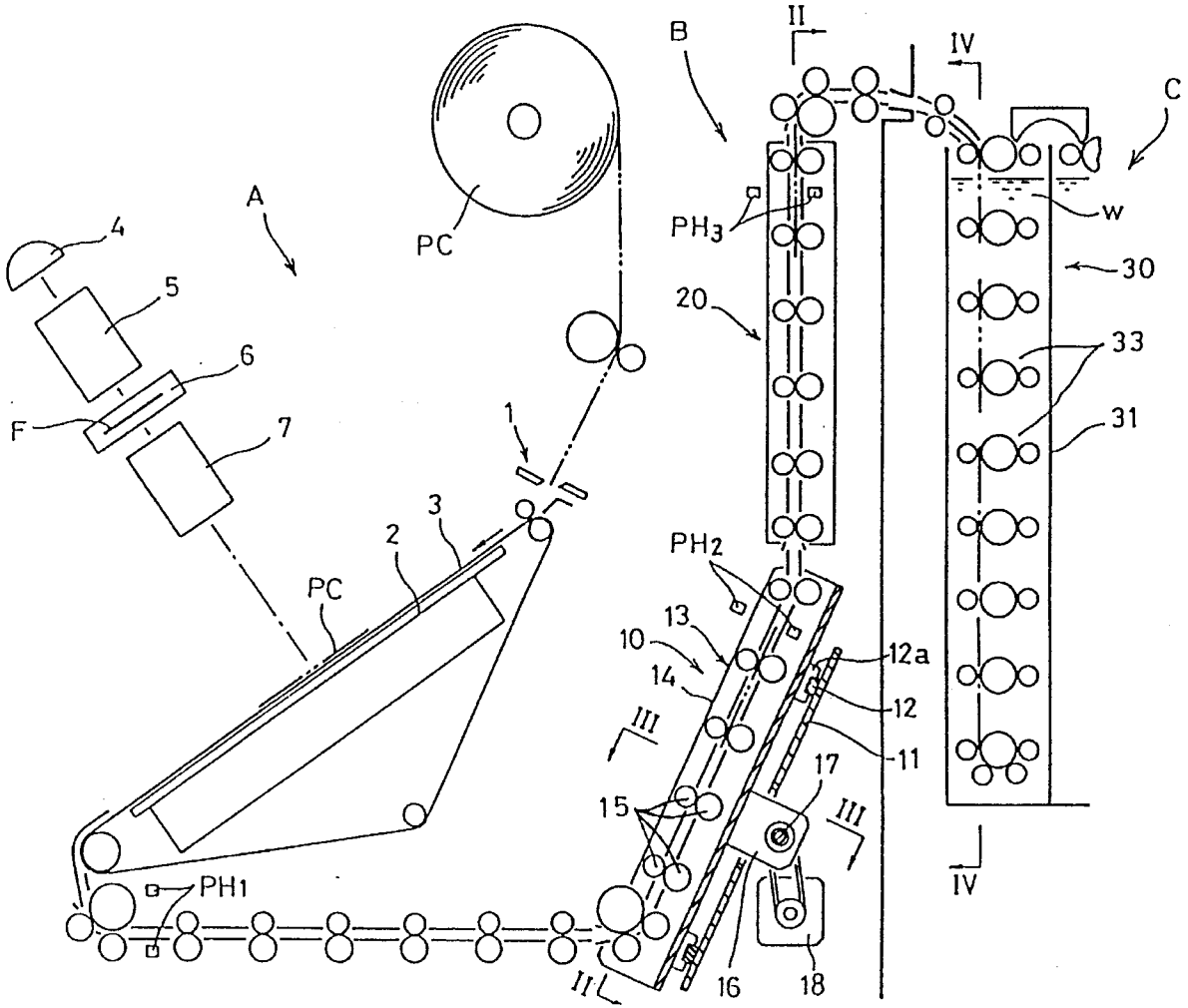
FIG. 1 is an enlarged cross-sectional view showing an interface section between the development station and the exposure station in a photographic printer machine of the present invention.

FIG. 1 is an enlarged cross-sectional view showing an interface area between the exposure station and the development station in a photographic printer machine in which a photosensitive material transfer method of the present invention is implemented. In the exposure station A, a photosensitive material PC is supplied from a roll by the action of feeder rollers and separated by a cutter 1 into frame size pieces which are transferred in a row to an exposure bed 2.

The exposure bed 2 has an endless suction belt 3 tensioned with a snub roller for running in a triangular shaped path. The pieces of photosensitive material PC are transferred to an exposure point while the suction belt 3 runs in a direction denoted by the arrow. More particularly, the suction belt 3 has a multiplicity of apertures provided in the surface thereof for sucking the photosensitive material pieces PC by the action of a vacuum. The photosensitive material pieces PC are exposed to light at the exposure point for printing pictures of a negative film F disposed adjacent to a shutter 6. The light emitted from a light source 4 is directed through a mirror tunnel 5, the shutter 6, and a lens unit 7 to the photosensitive pieces PC.

There are transfer guides provided along the transfer path extending from the exposure station A to a transfer section B and a development station C for guiding and preventing the photosensitive material piece PC from dislocating in their widthwise directions. Those guides are not shown for simplicity of the drawings.

The transfer section B comprises multiple pairs of rollers which are driven by corresponding endless belts. A transfer switch station 10 and a parallel transfer unit 20 are disposed in the middle of the transfer section B.

There are also mounted sensors $PH_1$, $PH_2$, and $PH_3$ for detecting the transfer movement of the photosensitive material pieces PC.

Figure 2:
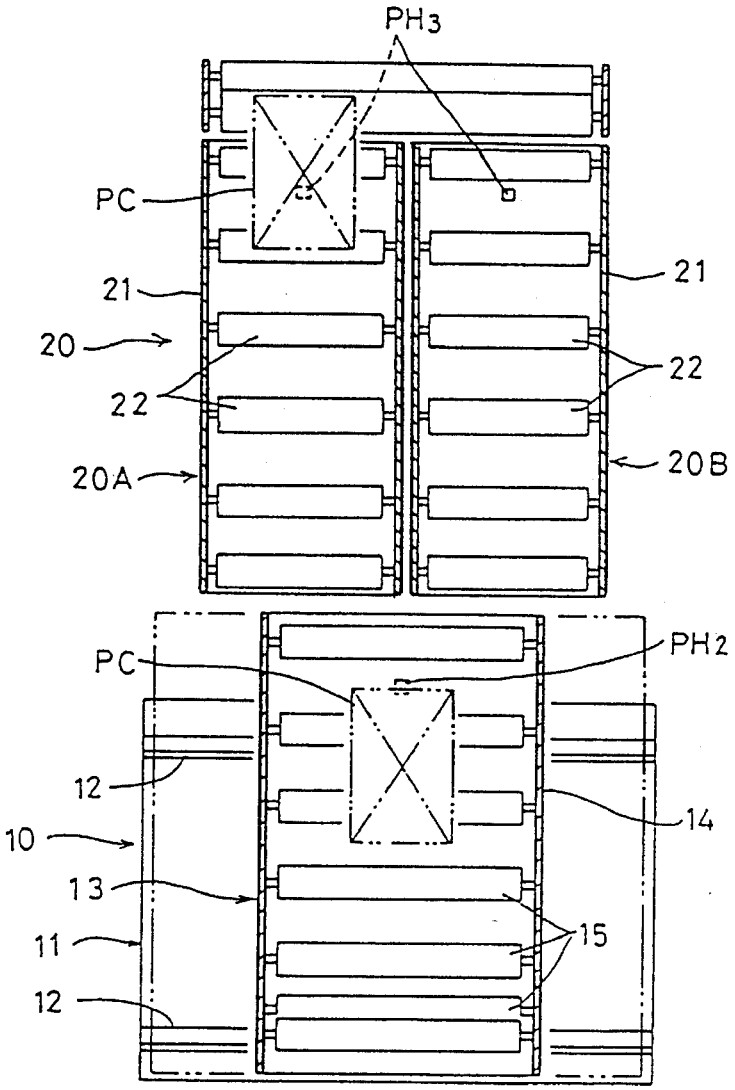
FIG. 2 is a cross-sectional view taken along the line II—II of FIG. 1.
Figure 3:
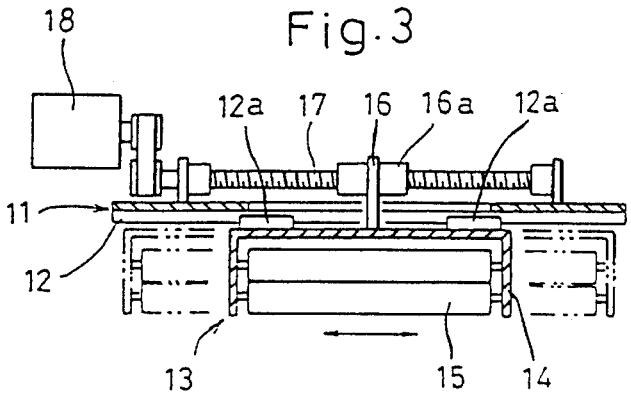
FIG. 3 is a cross-sectional view taken along the line III—III of FIG. 1.

FIGS. 2 and 3 are cross-sectional views taken along the lines II—II and III—III of FIG. 1 respectively. The constructions shown are arranged in substantially a vertical direction.

The switch station 10 includes a traverse carrier 13 mounted on rails 12 of a base 11 for movement at a right angle to the transfer direction of the photosensitive material pieces PC. The traverse carrier 13 comprises a carrier frame 14 and multiple pairs of roller 15. The carrier frame 14 has at bottom guides 12*a* which are slidably fitted into the rails 12.

A projecting arm 16 extends from the bottom of the frame 14 of the traverse carrier 13 across a main body to a rear side of the base 11. The projecting arm 16 has a thread region 16*a* provided on a distal end thereof for accepting a ball screw 17. When the ball screw 17 is driven by a motor 18, the traverse carrier 13 travels to left and right of the transfer path.

The parallel transfer unit 20 comprises two transfer paths 20A and 20B extending parallel to each other, as shown in FIG. 2. Each path includes multiple pairs of rollers 22 mounted on a base 21. In action, the photosensitive material pieces PC are transferred along the transfer path while the roller 21 are driven by an unshown endless belt connected to a motor. The two transfer paths 20A and 20B are driven separately and also, their speeds can be changed to fast or slow relative to each other. In common, the speed at a loading side or entrance of the transfer unit 20 is faster than that at an unloading side or exit.

The two transfer paths 20A and 20B are substantially identical in the width which is equal to that of the exposure bed 2. This means that the parallel transfer unit 20 is two times greater in the width than the exposure bed 2. The with of the transfer switch station 10 is more than two times greater than that of the exposure bed 2 for ease of the traverse movement.

Figure 4:
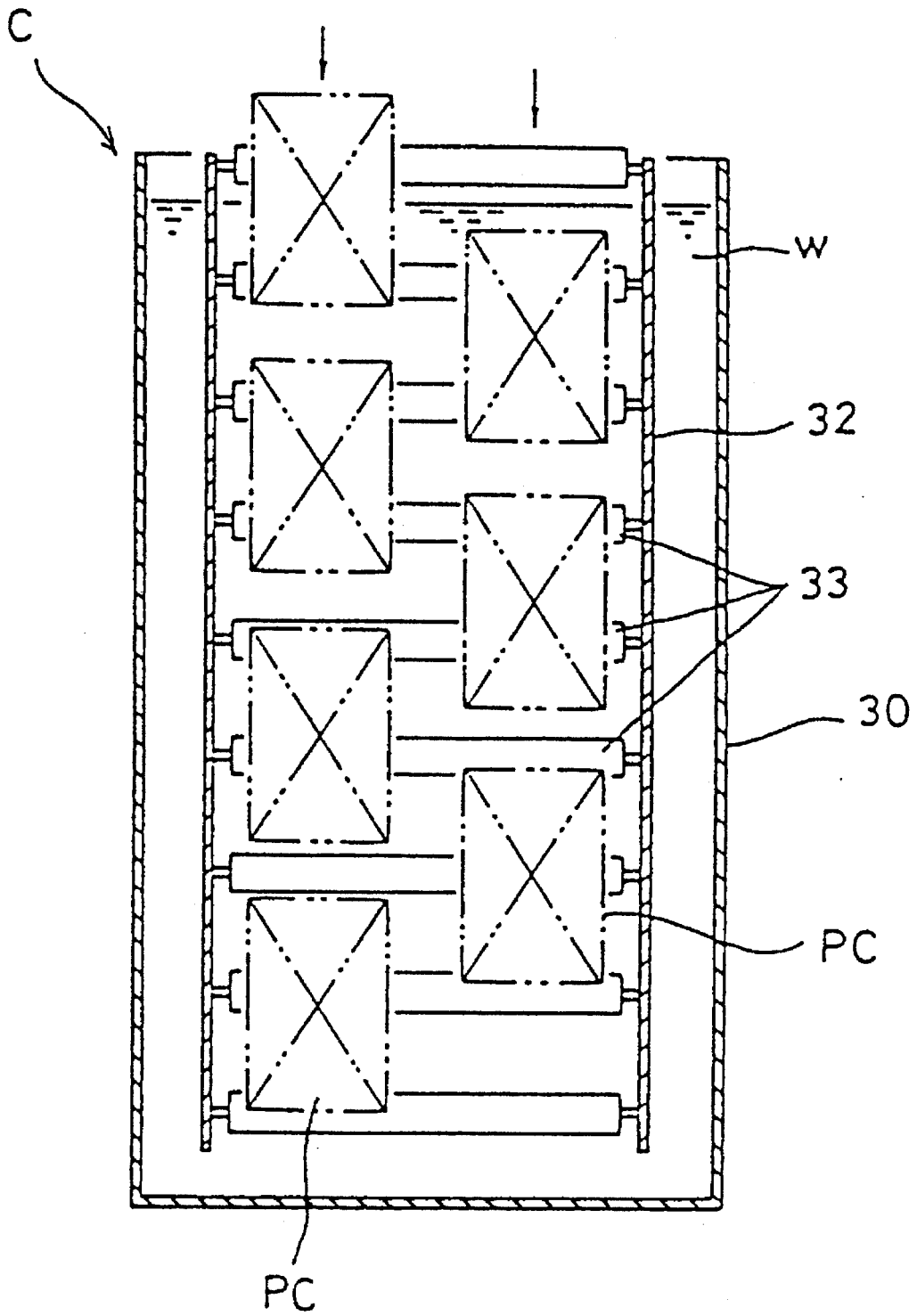
FIG. 4 is a cross-sectional view taken along the line IV—IV of FIG. 1.

FIG. 4 is a cross-sectional view taken along the line IV—IV of FIG. 1 and showing an interior construction of the development station C. A tank 30 in the development station C is separated by partitions 31 to form a plurality of compartments which are filled with different developing liquids W for carrying out chemical treatments of the photosensitive material pieces PC. It is understood that only one compartment in the tank 30 is shown in FIG. 4 for simplicity while the other compartments are unshown.

In each compartment of the tank 30, a rack is provided having multiple pairs of roller 33 supported by a frame 32. The width of the rack (or the rollers) is equal to that of the parallel transfer unit 20. The tank 30 has size sufficient for accommodating the rack of the width.

As shown in FIGS. 1 and 4, the photosensitive material pieces PC are transferred form the transfer section B to the development station C via an intermediate transfer path where they are deflected so as to move into the tank 30.

While the rollers in the exposure bed 2 at the exposure station A and in a transfer path before the transfer switch station 10 are driven by a given motor, the rollers in a transfer path before the cutter 1, in the switch station 10, and in the parallel transfer unit 20 are driven by their respectively motors. Those driving arrangements are not shown in FIGS. 1 to 4.

Figure 5:
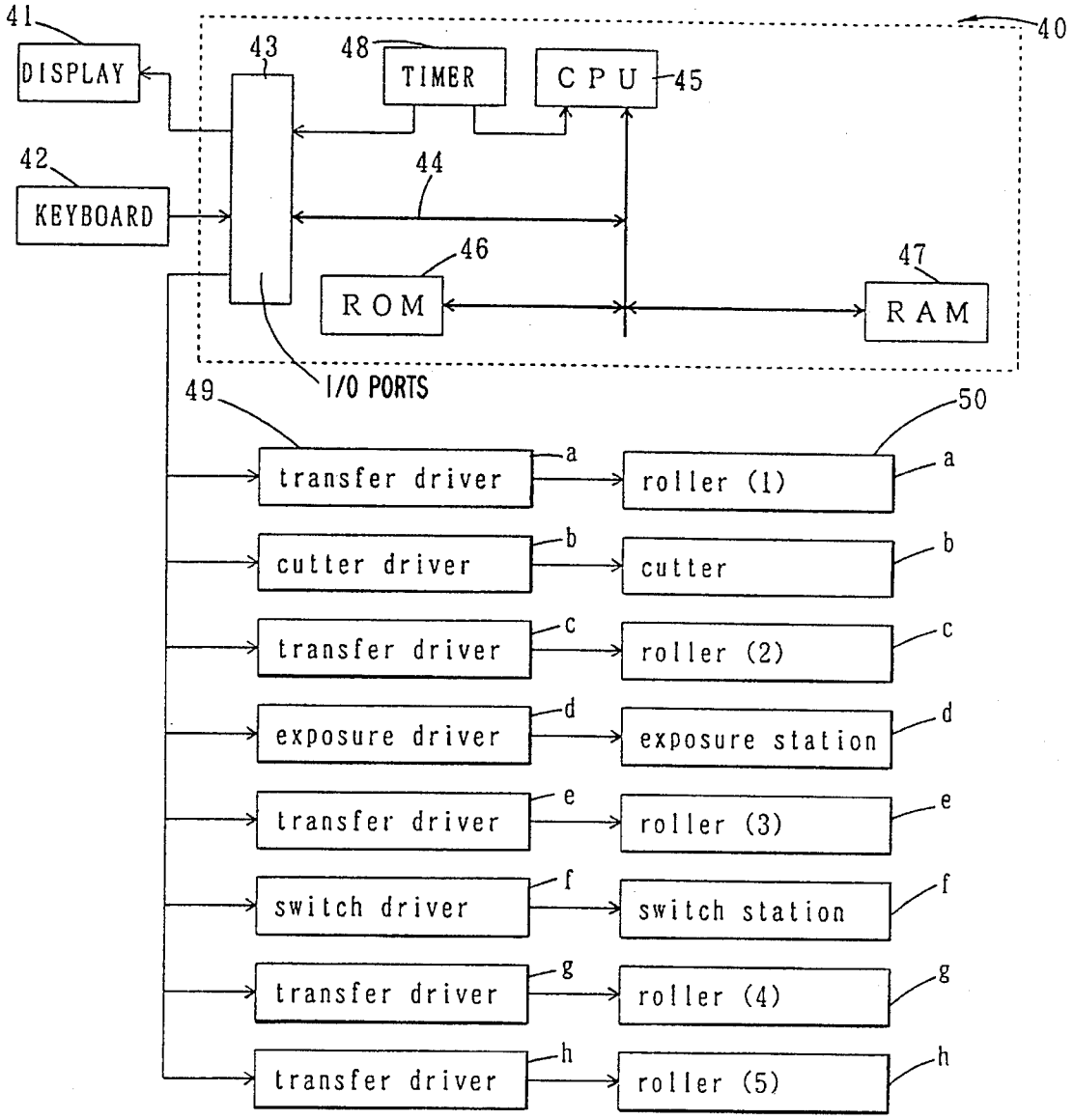
FIG. 5 is a schematic block diagram of a control circuit of the photographic printer machine of the present invention.

FIG. 5 is a schematic block diagram of a control circuit in the photographic printing machine of the present invention. The control circuit is designed for controlling the action of components of a microcomputer 40 including a display 41 for display of messages and a keyboard 42 for manual entry of a transfer start command, a YES or NO command for selecting the cleaning process (which will be explained later in more details), and other control commands.

The above commands are entered through I/O ports 43 into the microcomputer 40 and their relevant data are transmitted through a bus 44 and stored in a read only memory (ROM) 46 and a random access memory (RAM) 47 in response to the action of a central processing unit (CPU) 45. Denoted by 48 is a timer circuit. The ROM 46 also holds a basic program for performing the control actions. The RAM 47 temporarily holds a signal indicative of more than one hour elapsing after the setting of the timer 48 and the YES or NO command signal for selecting the cleaning process.

According to logic operations of the arithmetic control circuit of the microcomputer 40, various control signals are produced and delivered in timing for actuating the components in the photographic printer machines. More specifically, the control signals are transmitted to a group of drivers 49*a* to 49*h* for actuating their respective components with desired timing.

The action of exposure and development processes in the photographic printer machine of the present invention will now be described.

In the exposure and development processes, a series of small sized pieces of the photosensitive material PC are handled in succession while they are separated into two rows by the transfer switch station 10 to run with a zigzag form.

As the photosensitive material pieces PC are carried in two rows over the rollers 33 in the tank 30 of the development station C, they allows dirt to deposit between the two rows on the rollers 33. The dirt may result from chemical extraction of ingredients from the developing liquids which is caused by change in the temperature.

If a larger size piece of the photosensitive material is introduced, it may be fouled on its back with a trace of the dirt. In such a case, the exposure and development processes have to be repeated to produce a replacement. Also, portions of the dirt may pollute the edge of the standard size pieces transferred in two rows. According to the present invention, the transfer of photosensitive material pieces across the development station is selected between two alternate modes, a one-row mode and a two-row mode, for preventing the rollers from being fouled with impurities.

Prior to the explanation of the selection between the two alternate transfer modes, the two-row transfer mode will be described as is a standard mode.

A series of the photosensitive material pieces PC exposed to light at the exposure station A are driven by the rollers in the transfer section B and fed to the transfer switch station 10. As the traverse carrier 13 is located in the center position (referred to as a front position hereinafter), it accepts each photosensitive material piece at the front position which coincides with a centerline of the switch station 10.

As shown in the respective steps of FIGS. 9A–9E, the traverse carrier 13 while feeding the photosensitive material pieces to a downstream is moved to the left. As the traverse carrier 13 travels to the left at the step of FIG. 9A, the first piece $PC_1$ is moved to the transfer path 20A at the step of FIG. 9B. At the step of FIG. 9C, the first piece $PC_1$ is further advanced at a higher speed to near the forward end of the transfer path 20A. Then, as the transfer speed is shifted to slow, the traverse carrier 13 moves back to its original front position.

Figures 9A, 9B, 9C, 9D, 9E, 9F, 9G:
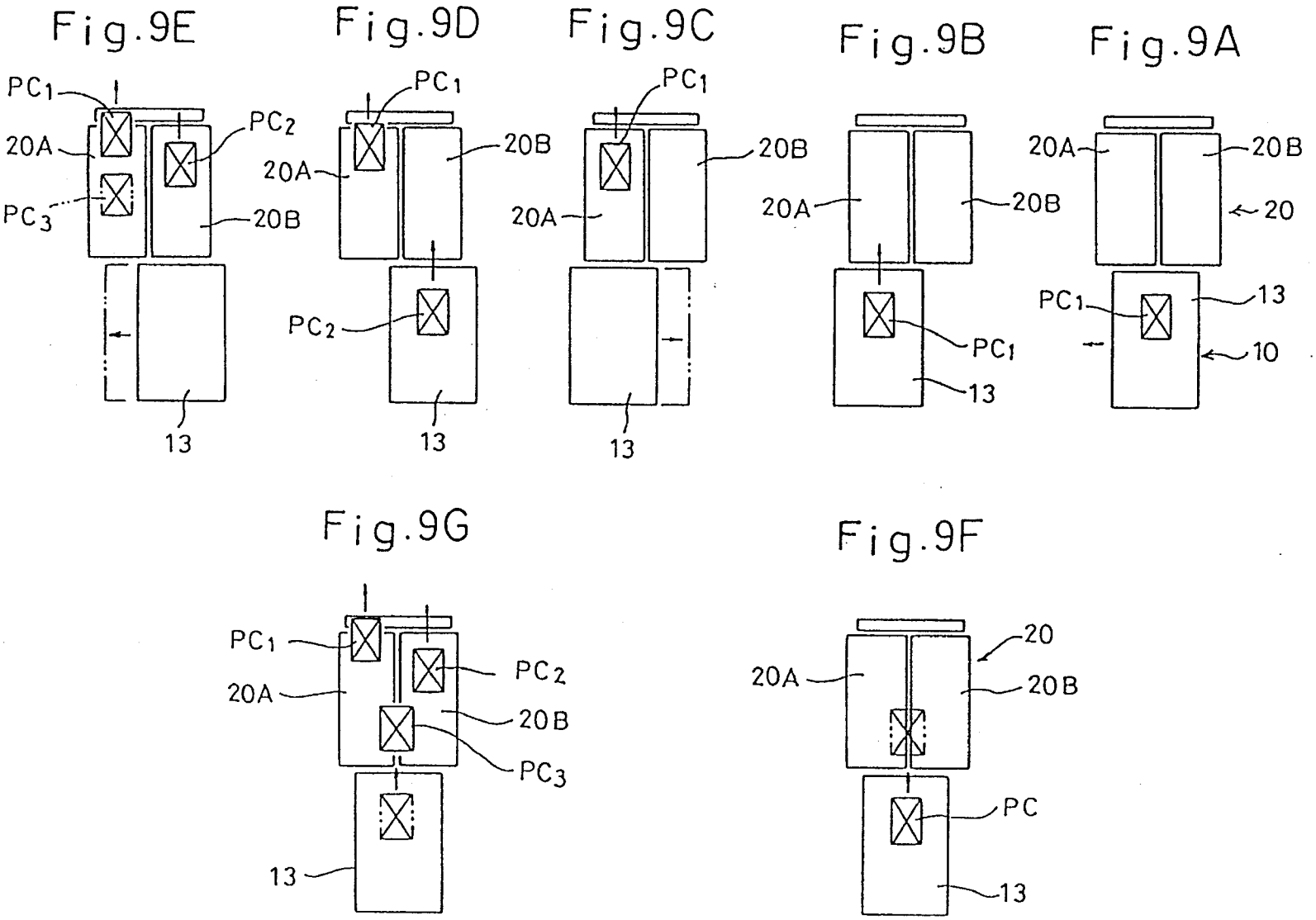
FIGS. 9A–9G are explanatory view showing the action of common two-row transfer, cleaning, and one-row transfer.

As shown in the step of FIG. 9D, while the first piece $PC_1$ is transferred at a slower speed, the traverse carrier 13 receives the second piece $PC_2$ and travels to the right or transfer path 20B side. The second piece $PC_2$ is moved into the transfer path 20B and advanced at a higher speed towards the forward end of the same before transferred at a slower speed similar to the $PC_1$.

At the step of FIG. 9E, the two pieces $PC_1$ and $PC_2$ are further carried at the same slower speed to the development station C. Simultaneously, the traverse carrier 13 returns to the front position to receive a third piece $PC_3$. As the third piece $PC_3$ is located as denoted by the one-dot chain line, the three pieces $PC_1$, $PC_2$, $PC_3$ are arranged in a zigzag form to run in two rows to the development station C.

Figure 6:
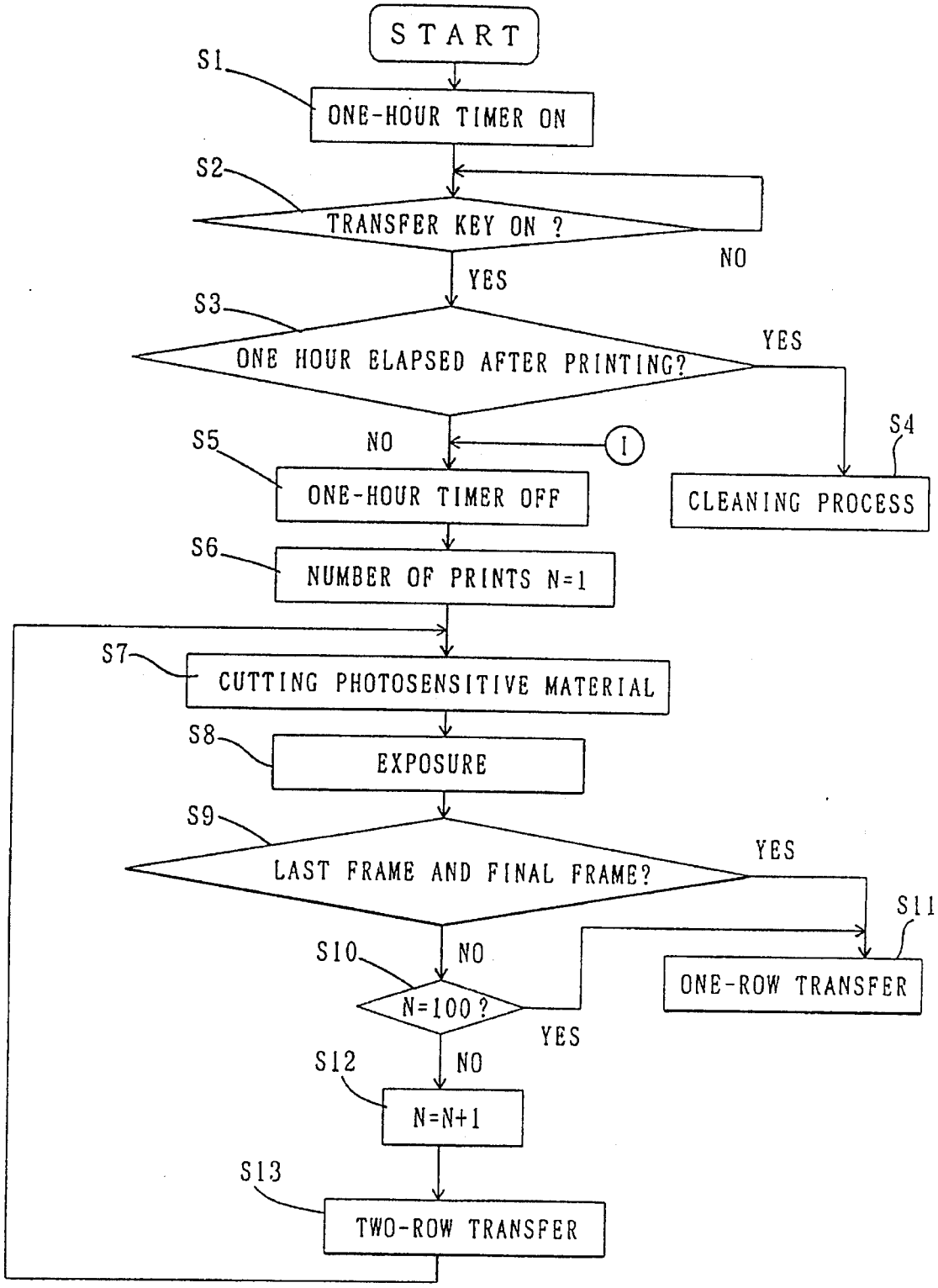
FIG. 6 is a flowchart of a control procedure in the control circuit.

The two-row transfer mode may be alternated with the one-row mode for preventing fouling with dirt at the development station C. FIG. 6 is a schematic flowchart showing a procedure of selection between the two alternate transfer modes.

When the photographic printer machine is energized, the one-hour timer (48 in FIG. 5) is turned on at Step S1. The one-hour timer is provided for judging the need of the cleaning process (of Step S4 which will be described later) by examining whether or not a stall time is more than one hour. The stall time is commonly given after completion of the action in the one-row transfer mode (of Step S11 which will be described later) and the fouling with dirt will be accelerated during the stall time.

When the timer 48 is on, the stall time can be measured. The timer 48 remains activated by a supplement power source for counting an interval of time from a temporary stop action to a restart action while the photographic printer machine is disconnected.

At Step S2, a determination is made as to whether or not a corresponding key on the keyboard 42 is turned on for actuating the transfer rollers 50*a* disposed before the cutter 1. At Step S3, a determination is made as to whether or not one hour is elapsed after release of the last piece of photosensitive material PC (referred to as a print hereinafter because it has been exposed to light and is carrying a undeveloped image) from the transfer section B. When one hour has passed, the cleaning process is carried out before starting the two-row transfer mode (Step S4).

In the cleaning process, the prints are transferred in one row from the front position of the transfer switch station 10 to the development station C in a fashion similar to the one-row transfer mode. More specifically, one of the prints which has not been subjected to the exposure process is fed to the development station C to remove dirt from the central regions of the rollers.

Figure 7:
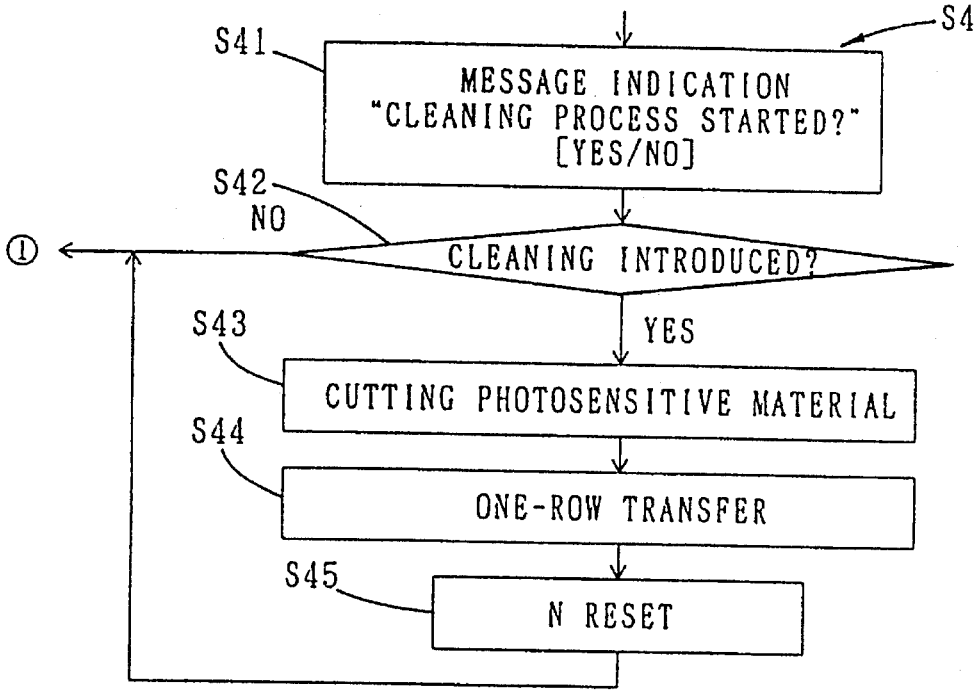
FIG. 7 is a flowchart showing a part of the control procedure.

The action of the cleaning process at S4 is illustrated in a flowchart of FIG. 7. The cleaning procedure starts with Step S41 where an yes/no message is displayed for asking whether or not the cleaning process is started. In this embodiment, an YES or NO command is entered through the keyboard 42. If the display 41 is a liquid crystal display, YES and NO signals to the microcomputer 40 may be produced by direct access to the yes/no message on the screen with a finger or a pen.

At Step S42, the signal of selecting the cleaning process is accepted but if the fouling with dirt on the rollers in the development station C is negligible with the elapsed time of more than one hour, the procedure goes back through a route 1 to the main routine. The execution of the cleaning process is determined by an operator viewing the rollers in the development station C.

When the YES command is given at S42, the procedure moves to Step 43 where one frame size piece is separated from the strip of the photosensitive material PC by the cutter 1. The frame size piece is not subjected to the exposure process of the exposure station A and driven by the transfer rollers 50*c* and 50*d* until it enters the transfer switch station 10.

As shown in the step of FIG. 9F, the frame size piece denoted by PC is carried through the parallel transfer unit 20 and fed to the development station C where it runs over the rollers and removes dirt from their central regions. As the traverse carrier 13 is moved to the front station, a counter for counting the number of prints is reset (to N=0) at Step S45 and the procedure goes back to the main routine.

The procedure is returned to the main routine in any of the cases when one hour has not elapsed after the passing of the preceding print, when the cleaning procedure has not been selected, and when the cleaning procedure has been selected and completed.

At Step S6 of the main routine, the counter for counting the number of prints is set to N=1 and at Step S7, one frame piece is separated from the photosensitive material PC by the cutter 1. At Step S8, a corresponding picture of the film F is printed on the frame size piece at the exposure station A or 50*d* which is actuated by the driver 49*d*.

A determination is made at Step S9 as to whether or not the frame size piece or print (N=1) is the last frame of a current film and the final one of reprint copies of the same picture. The last frame of a current film is a print which carries, for example, the last picture of a 36-frame order negative film. The final one of reprint copies is, for example, the second one of two identical copies of one specific picture or a third copy of three identical copies of a picture. In common, it is judged that the print is the last frame of the negative film as long as copies are not requested.

Figure 8:
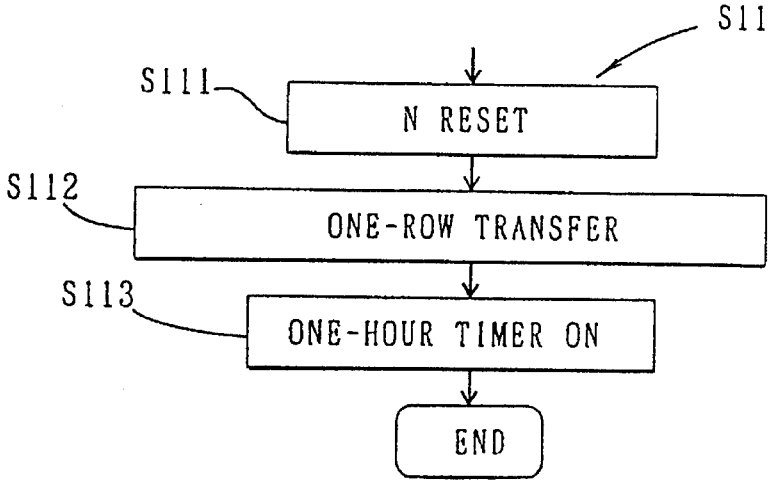
FIG. 8 is a flowchart showing a part of the control procedure.

If yes, the procedure goes to Step S11 where the one-row transfer action is carried out. More particularly, as best shown in FIG. 8, the action of Step S11 starts with resetting (N=0) of the number of prints (Step S111). Then, the transfer switch station 10 is shifted to its center position (Step S112) for transferring a single row of the prints to the development station C in the same manner as of the cleaning process (shown in the step of FIG. 9G). At Step S113, the one-hour timer is turned on and this routine is finished.

If a no is given at Step S9, the procedure moves to Step S10 where a determination is made as to whether or not N=100. This step is necessary due to the following reason. While the final frame of a current film request is transferred in one row, a judgment as to whether or not frames of the film request have been printed is executed at intervals of 6 frames. If the operator enters a command of printing not the last frame of the order, no is given at Step S9. As the result, the last frame of a succeeding order film may not be printed with the repeating the command action.

To prevent such a fault action, the one-row transfer action is introduced when N=100 at Step S10. The judgment as to whether or not each succession of 6 frames is to be printed is also needed because the frames of a request often include faulty pictures which may be under- or over-exposed. The 6-frame interval judgment allows the operator to identify the presence of any faulty picture through a view scope so that unnecessary prints can be eliminated.

In the embodiment, the action of Step S9 comes earlier than that of Step S10. The action of Step S10 may come earlier. As the one-row transfer action is always introduced at N=100, it is accepted that not printed frames exist when N is less than 100. It is also understood that the number of prints is not limited to N=100 and any appropriate number will be used with equal success.

If N=100 is not established at Step S10, the number of prints is increased by one at Step S12 without entering the one-row mode. Then, the transfer switch station 10 is actuated at Step S13 for leftward and rightward movement to transfer the prints in two rows.

As described, the transfer of prints before the development station C is carried out in two rows and if the action is halted for more than one hour, the cleaning process is systematically introduced to remove dirt from the rollers of the development station C with the one-row transfer mode. Also, after each two-row transfer mode action with N=100 is completed, it is shifted to the one-row transfer mode for carrying out the same cleaning process. Accordingly, the fouling of the rollers can be prevented without disturbing the advantage of the two-row transfer action in the development station C.

Figure 10:
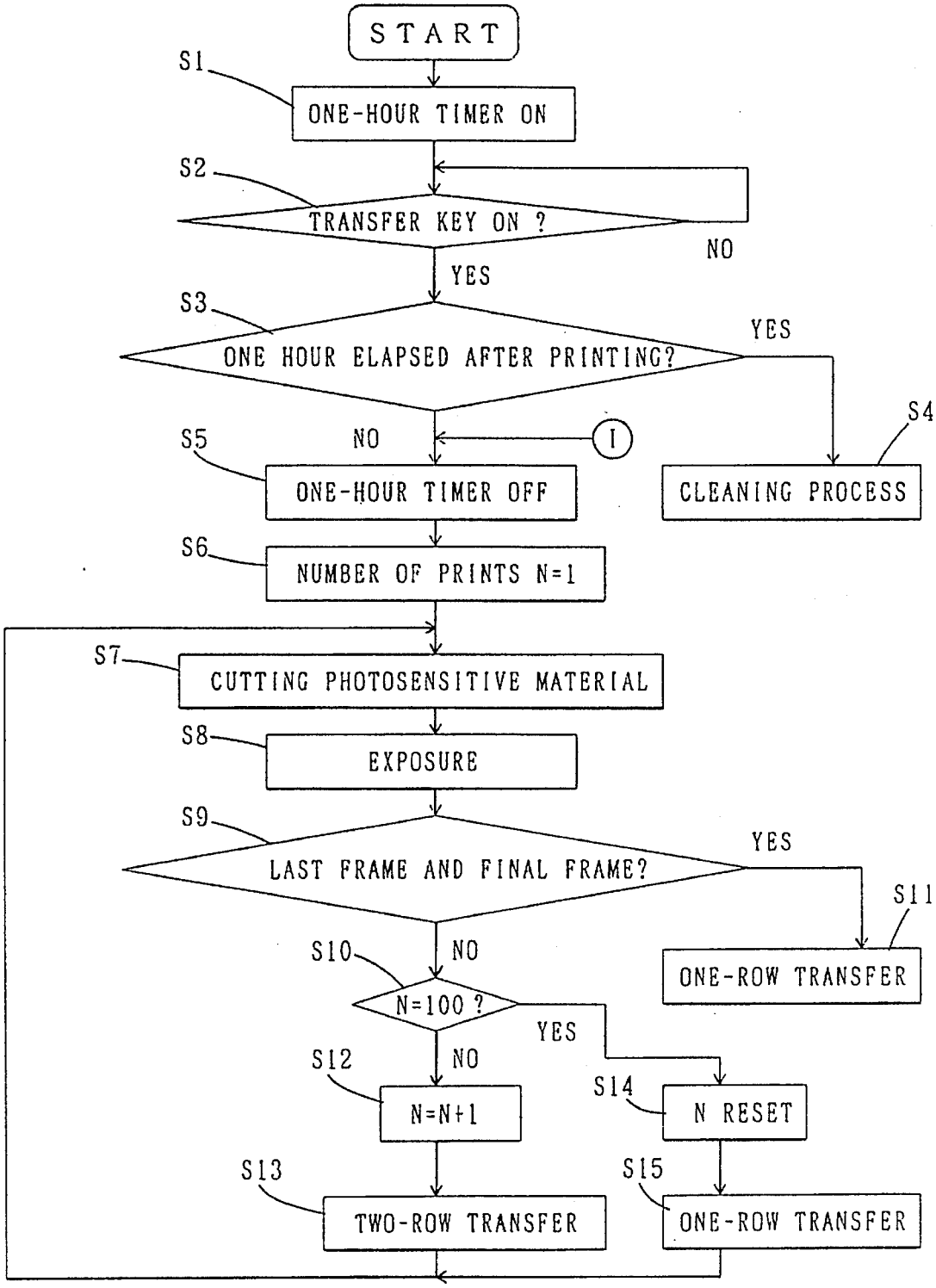
FIG. 10 is a flowchart showing a modification of the control procedure shown in FIG. 6.

FIG. 10 is a flowchart showing a second embodiment which is a modification of the method of the first embodiment. In the first embodiment, when the number of prints is N=100 at Step S10, the procedure goes to Step S11 and will be terminated after the routine shown in FIG. 8 is completed.

In the second embodiment, when N=100 is given, the number N is reset at Step S14 and the procedure goes to Step S15 where the transfer switch station 10 is shifted to its center position for carrying out the one-row transfer action. Then, the procedure is not terminated but returned back to between Step S6 and Step S7 for continuing the two-row transfer action. It is not necessary to stop the action of the development process whenever the one-row transfer action is introduced at N=100.

In both the embodiments, before the number of prints comes to 100, the one-row transfer action is executed for every order of prints according to the judgment at Step S9. This action is illustrative but not of limitative. If desired, the one-row transfer action is introduced any time during the processing of frames of an order.

It is also understood that the one-row transfer action for performing the cleaning process is not limited to one time but may be repeated until all the rollers are free from unwanted dirt according to the first and second embodiment.

A third embodiment of the present invention will be described referring to FIG. 11 and other drawing figures. In this embodiment, the transfer switch station 10 selects its action between transfer of prints of the photosensitive material PC in three or more rows to the development station C and transfer of rows of exposed or unexposed frame size pieces of the material PC through particular areas in the development station C where the prints do not pass in the normal operation.

As shown, the prints are transferred in three rows according to this embodiment and may be carried in four, five, or more rows with equal success as are not limited to the three rows.

The third embodiment includes components and their arrangement similar to those of the first embodiment and will be described in the respect of specific features. As like components are denoted by like numerals, they will not be explained in greater detail.

Figure 11:
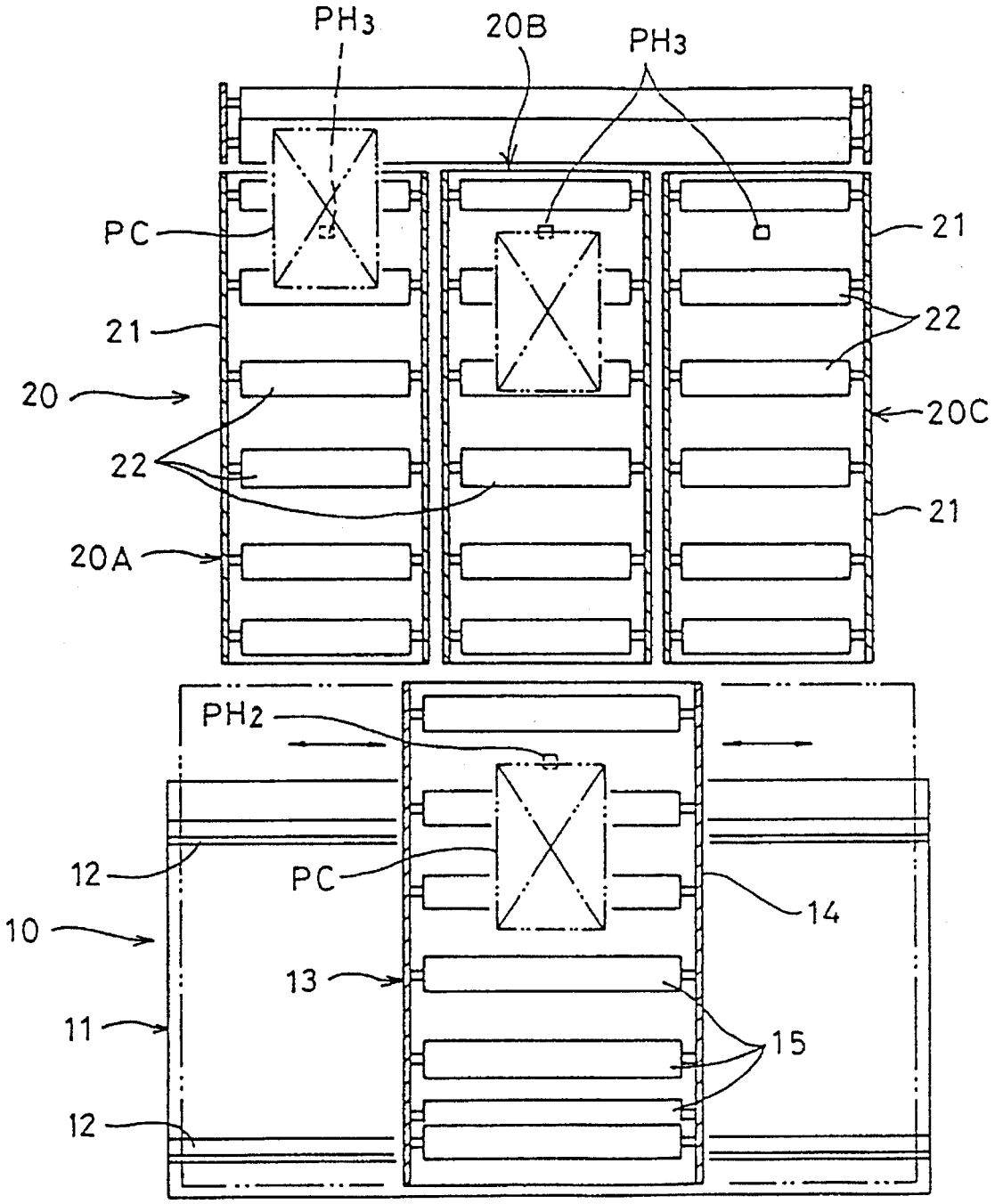
FIG. 11 is a cross-sectional view similar to FIG. 2, where frame pieces of a photosensitive material are transferred in three parallel rows.

As shown in FIG. 11, the transfer switch station 10 and the parallel transfer unit 20 of this embodiment are adapted for separating a single row of prints supplied from the exposure station A into three rows which are then carried through the parallel transfer unit 20.

Figure 12:
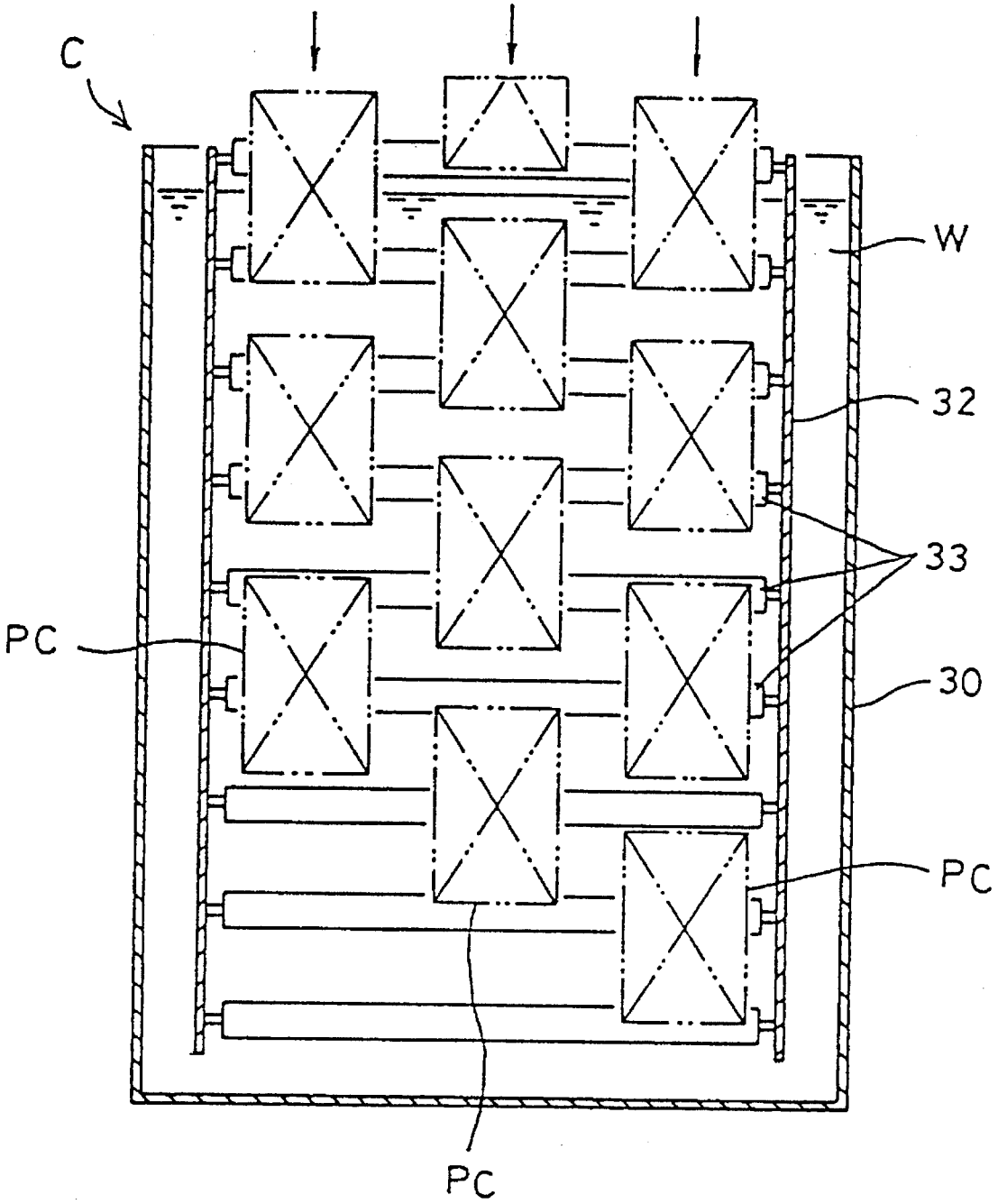
FIG. 12 is a cross-sectional view similar to FIG. 4 but in case of the transfer mode shown in FIG. 11.

FIG. 12 is similar to FIG. 4 and illustrates a main interior construction of the development station C. As shown, the prints are transferred in three rows. Hence, the cleaning procedure can be executed by transferring prints into plural (two) rows as compared with one row in the first embodiment.

The action of the third embodiment will be described which is differed from the first embodiment. The one-row transfer action and the two-row transfer action according to the two, first and second, embodiments are referred to as inter-row transfer and multiple-row transfer respectively for ease of the explanation. It is however noted that the inter-row transfer and the multiple-row transfer are substantially employed as synonymous terms since the first and second embodiments are exemplary cases of the third embodiment for performing the same processes.

Figure 13:
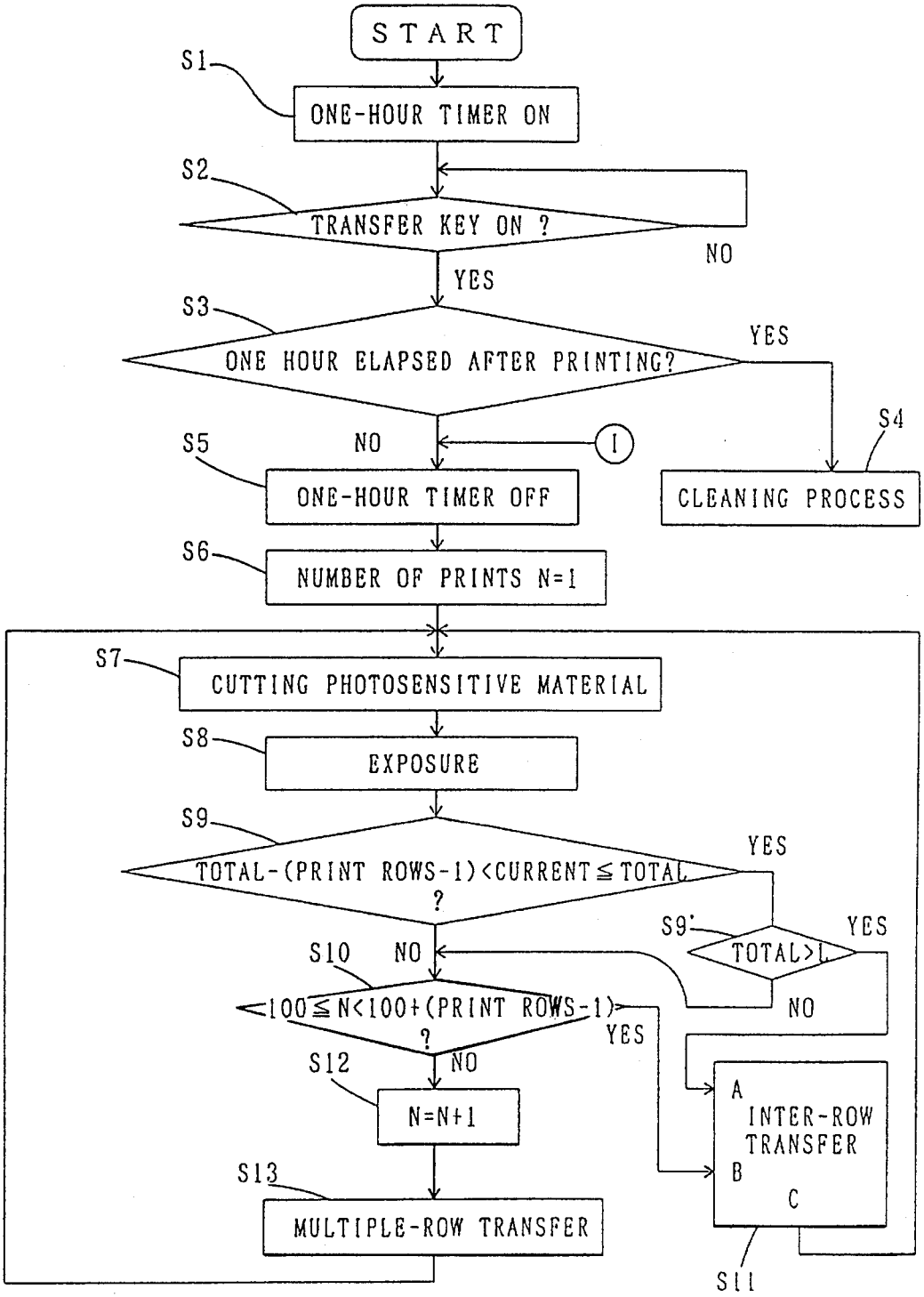
FIG. 13 is a flowchart, similar to FIG. 6, of the transfer mode shown in FIG. 11.

FIG. 13 is a flow chart of executing the action of the third embodiment. At step S3, a determination is made as to whether or not one hour has elapsed after the end of a printing action. If yes, the cleaning process is carried out at Step S4 similar to that of the first embodiment.

This embodiment is different from the first embodiment in the fact that the cleaning procedure is done with plural rows of prints (namely, two rows shown in FIG. 12). The cleaning process starts with Step S40 where a counter for counting the number of rows M is reset. The number M is equal to the number of rows of prints minus one. For example, when the photosensitive material prints are transferred in three rows, M is 2.

Figure 14:
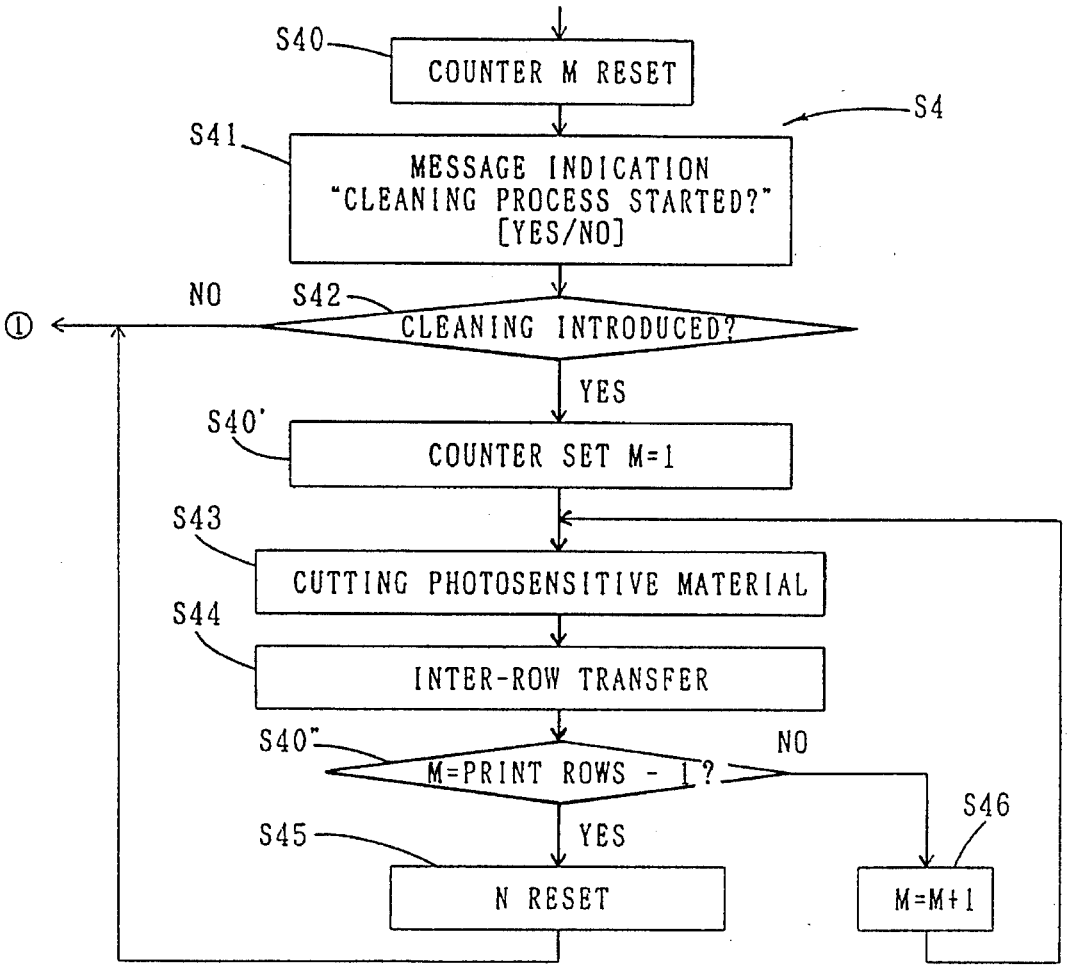
FIG. 14 is a flowchart of the cleaning process.

At Step S41 of FIG. 14, a message is displayed and at Step S42, a determination is made as to whether or not the cleaning process is introduced. If the cleaning process is selected, the counter is set to M=1 at Step S40'. At Step S43, pieces are separated from the strip of the photosensitive material PC and subjected to the inter-row transfer action at Step S44 for carrying out the cleaning process.

At Step S40", a determination is made as to whether or not M is equal to the number of print rows minus one. If no, the number M is increased by one at Step S46 and the procedure goes back to Step S43 to repeat the preparation of the cleaning process. When the cleaning process is completed with the number M equal to the number of print rows minus one, the number of rows of the prints is reset at Step S45 and the procedure moves to the exit point 1 shown in FIG. 13. In this manner similar to that of the first embodiment, the rollers in the development station C are cleaned.

From Step S5 of FIG. 13, the procedure further advances to Steps S6, S7, and S8. When relevant requirements are satisfied at Steps S9 and S10, the inter-row transfer mode is introduced at Step S11. If the requirements are not met, the number N is increased by increment at Step S12 and followed by the action of Step S13 where the prints are transferred in a predetermined number of rows through the development station C as well as the action of the first embodiment.

The requirement at Step S9 is expressed by:

$$\text{total number of frames}-(\text{number of print rows}-1)<\text{number of current frames}\leqq\text{total number of frames}.$$

The number of print rows minus one is the number of rows for performing the inter-frame transfer action. Accordingly, when the number of current frames is smaller than the total number of the frames but greater than a difference between the total frame number and the number of rows of prints minus one, yes is given at Step S9.

For example, when the prints of a 24-frame film are transferred in three rows, the 23rd and 24th frames which are between 24th and 22nd determined by 24−3(3−1)=22 are subjected to the inter-row transfer action of Step S11.

When yes is given at Step S9, it is then examined at Step S9' whether or not a negative film length to be printed is longer than L (film length (=number of frames)>L). L may be stored or entered by the operator using the keyboard or other input device.

As a common negative film length contains six or less frames, L=7 is preferred. More particularly, this judgment is needed when a client brings a 6-frame film length for having copy prints rather than a 12-, 24-, or 36-frame full negative film which is loaded for printing directly after subjected to the initial film development. If the 6-frame film length is treated as the full frame film, the inter-row transfer action claims a time loss. The time loss will be explained later in more detail.

If the film length to be printed is greater than L (yes at Step S9'), i.e. the film is a full frame film, the inter-row transfer action is introduced. Otherwise, no inter-row transfer action is executed to avoid declination of the working efficiency.

Figure 15:
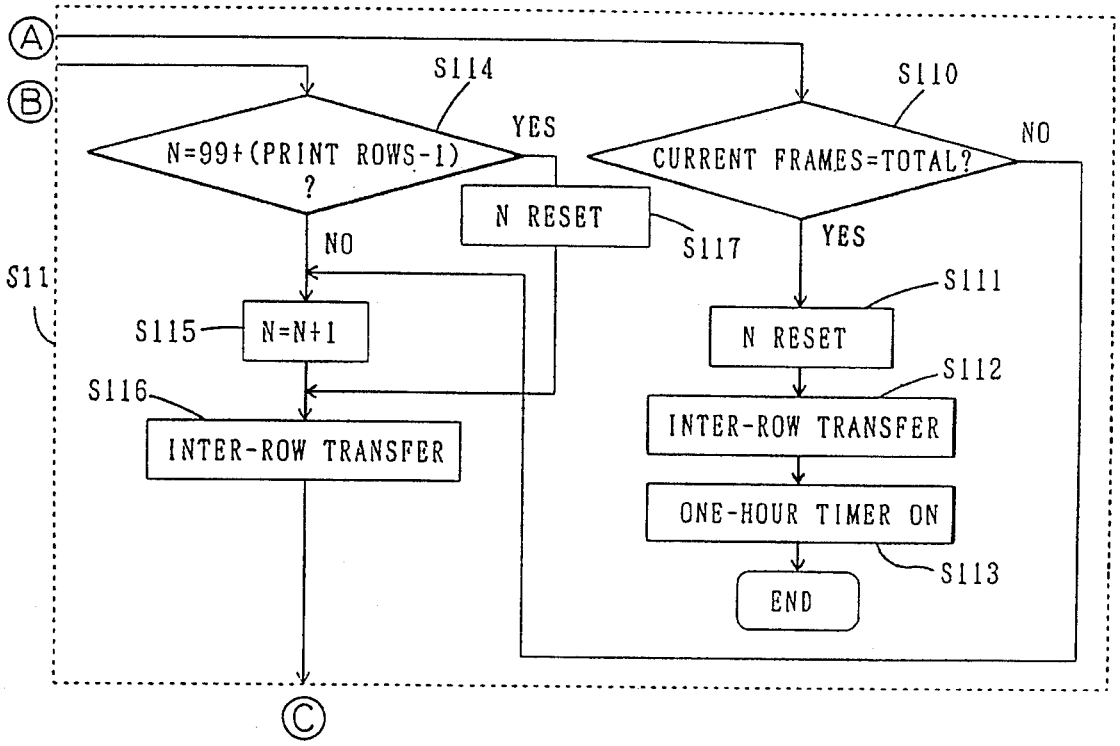
FIG. 15 is a flowchart of an inter-row process.

FIG. 15 is a flowchart of performing the inter-row transfer action of Step S11. The procedure of the action includes two flows A and B of steps depending on the requirements at Steps S9 and S10. The routine A will first be explained in relation to the action of Step S9.

The routine A starts with examining the number of current frames at Step S110. A determination is made as to whether or not the number is equal to the total number of frames. For example, this routine is carried out when the 23rd and 24th frame of a 24-frame film are detected. If the number is 23, no is given at Step S110. If 24, yes is output.

When the number is 23, the procedure goes to Steps S115 and S116 for the inter-row transfer action, which will be described later, where the number of prints is increased by one and the inter-row transfer action is carried out. After the action, the procedure goes back via the exit C to between Step S6 and Step S7 of FIG. 13 for releasing the photosensitive material for another 24-frame negative film.

When the 24th print is loaded to the transfer switch station 10, the number of frames comes equal to the total number and the procedure moves to Step S110. After the number of prints is reset, the inter-row transfer action is executed at Step S112. At Step S113, the one-hour timer is turned on before the procedure of developing the prints of a film request is terminated as well as the first embodiment.

As described, when the last frame of the prints of a film is used for the inter-row transfer action, the transfer of all the frames to the development station C is completed. While the previous prints are transferred in three or more rows for development, extra pieces of the photosensitive material are provided in plural rows smaller by one than the number of the print rows for cleaning. It is thus understood that the more the number of rows for performing the inter-row transfer action, the more the number of pieces of the photosensitive material is needed.

The inter-row transfer action may be repeated as well as the first or second embodiment if the rollers in the development station C are heavily fouled with dirt. It may also be executed anytime during the transfer of an order film if desired.

Returning to FIG. 13, when no is given at Step S9', a determination is made at Step S10. This step is adapted in addition to the first embodiment to determine whether or not the length of a negative film segment is greater than a given length L (film length(=number of frames)>L). If yes, the inter-row transfer action is introduced. Otherwise, no is given at Step S9' and the inter-row action is not conducted. The action at Step S10 is similar to that of the first embodiment. In this embodiment, the inter-row transfer action is however executed with plural rows. Hence, the requirement is expressed by:

$$100 \leqq \text{number of prints (N)} < 100 + (\text{number of print rows} - 1).$$

As the number of print rows is 3 in the third embodiment, the above is simplified to 100≦number of prints<102. Accordingly, when the number of prints is 100 or 101, the procedure goes to Step S11 for performing the inter-row transfer action.

As shown in FIG. 15, the procedure then moves further to Step S114 of the routine of Step S11. The number of prints is again examined to determine whether or not it is equal to 99+(number of print rows−1). This means to determine whether or not N=101. If N is not 101 or N=100, the inter-row transfer action is conducted at Step S116 and then, the procedure goes from the exit C to between Step S6 and Step S7 for starting transfer of the 101st frame.

When N=101, it is identified at Step S114. After the number of prints N is reset at Step S117, the inter-row transfer action is executed at Step S116 before the procedure goes back from the exit C to between Step S6 and Step S7 for continuing the multiple-row transfer action.

As understood, the procedure is not terminated according to the third embodiment.

As the number of rows of prints of the photosensitive material increases from three to more, the rows for the inter-row transfer action are increased to 2, 3, 4, . . . When the number of print rows is 4, the inter-row transfer action is conducted at the 100th and 101st frames and after the number of prints N is reset, the cleaning procedure is terminated with the 102nd frame. When the number of print rows is 5, the inter-row transfer action is conducted at the 100th, 101st, and 102nd frames and after the number of prints N is reset, the cleaning procedure is ended with the 103rd frame. Accordingly, pieces of the photosensitive material are fed corresponding to the number of cleaning rows.

Figure 16A:
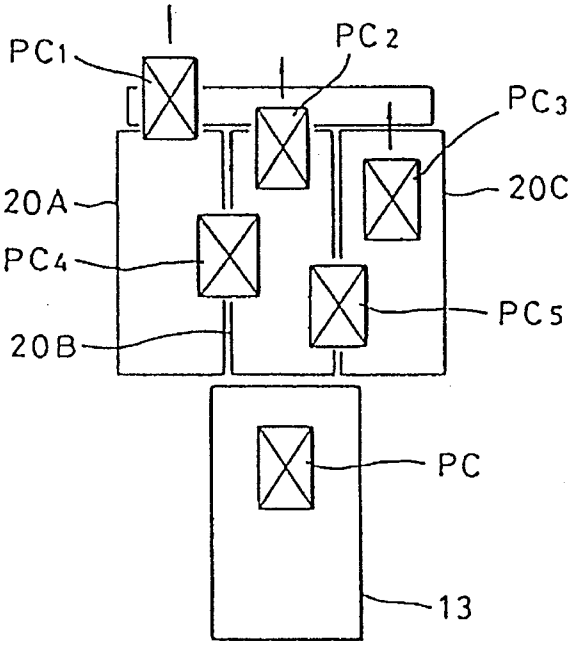
FIGS. 16A–16B are schematic views showing transfer states in a transfer switch station and the development station.
Figure 16B:
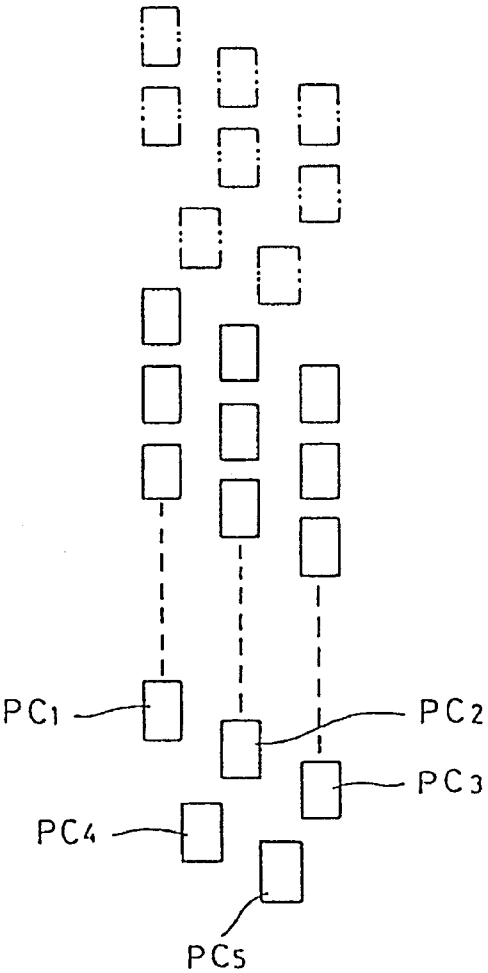
Figure 17A:
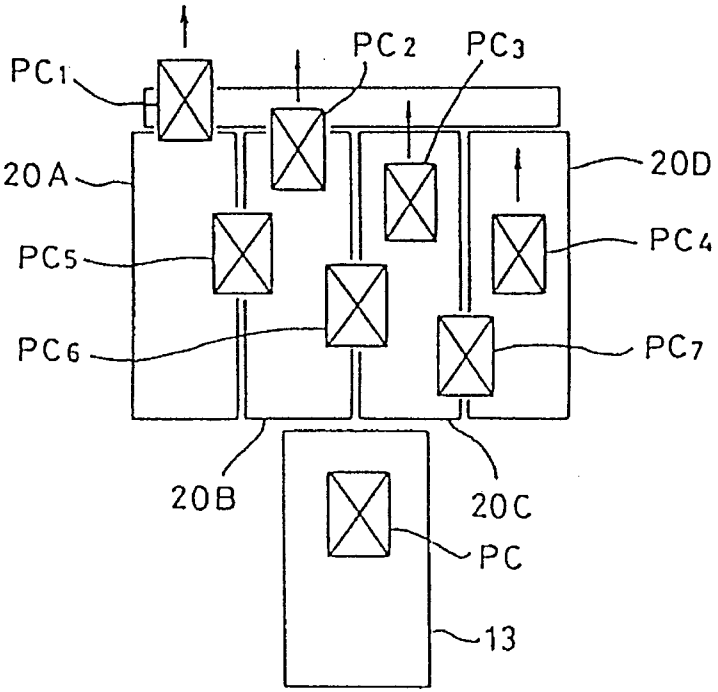
FIGS. 17A–17B are schematic views similar to FIG. 16, where frame pieces of a photosensitive material are transferred in four parallel rows.
Figure 17B:
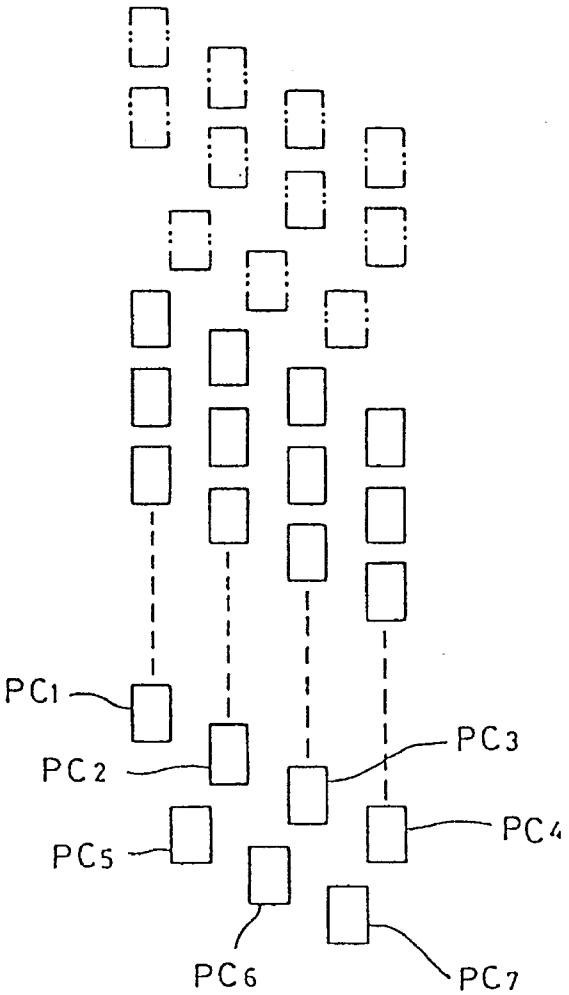

FIGS. 16A–16B and 17A–17B show the transfer actions of the third embodiment. As shown in FIGS. 16A–16B, while the prints are transferred in three rows, they are designated by the transfer switch station 10 to run along the parallel transfer unit 20 and they run with the multiple-row transfer mode through the development station C with two rows of cleaning pieces introduced in the inter-row transfer action. In FIGS. 17A–17B, in a fashion similar to that of FIGS. 16A–16B, the prints are transferred in four rows while cleaning pieces are carried in three rows.

The generation of a time loss during the judgment as to whether or not the negative film length having 6 or less frames is longer than L at Step S9' will be apparent from FIGS. 16A–16B and 17A–17B. It is now assumed that three prints $PC_1$, $PC_2$, and $PC_3$ are fed in a zigzag form and followed by two cleaning pieces $PC_4$ and $PC_5$, as shown in FIGS. 16A and 16B.

As apparent from the drawings, $PC_1$, $PC_2$, and $PC_3$ are overlapped along the transfer direction. If the switch to the inter-row transfer action is not executed, $PC_4$ may trace the path of $PC_1$. Because of the switching action, the transfer is made in a zigzag form which thus results in the time loss during the action.

What is claimed is:

1. A photosensitive material transfer method in a photographic printer machine which exposes images in frames of a film to pieces of photosensitive material, the exposure being effected by a request for the printing of the film, the method comprising:

a multiple-row transfer mode in which the exposed photosensitive material pieces are separated into multiple rows and the rows of the photosensitive material pieces are transferred in controlled speeds and;

an inter-row transfer mode in which other photosensitive material pieces which have not been exposed are carried across regions between the multiple rows so as to run in one or more rows, wherein the multiple-row transfer mode and the inter-row transfer mode are selectively effected during the transfer of photosensitive material pieces from an exposure station to a development station such that the non-exposed pieces of photosensitive material clean the machine, thereby preventing staining of the exposed pieces of photosensitive material.

2. A photosensitive material transfer method in a photographic printer machine as claimed in claim 1, wherein:

the selection is conducted by when the transfer action is continued after a given interval of stop action, carrying out the inter-row transfer mode action and then, shifting to the multiple-row transfer mode.

3. A photosensitive material transfer method in a photographic printer machine as claimed in claim 2, wherein:

the transfer action is shifted from the multiple-row transfer mode to the inter-row transfer mode when the photosensitive material pieces carried in multiple rows are counted up to a given number.

4. A photosensitive material transfer method in a photographic printer machine as claimed in claim 3, wherein:

the shift of the transfer of the photosensitive material pieces from the multiple-row transfer mode to the inter-row transfer mode is executed for every request or in any intermediate length point of the request.

5. A photosensitive material transfer method in a photographic printer machine as claimed in claim 4, wherein:

the shift of the transfer to the inter-row transfer mode is executed when a total number of frames minus (number of rows of photosensitive material pieces −1)<number of current frames≦total number of frames is satisfied.

6. A photosensitive material transfer method in a photographic printer machine as claimed in claim 5, wherein:

the shift of the transfer from the multiple-row transfer mode to the inter-row transfer mode is executed when a film length contains more than a predetermined number of frames.

* * * * *